US006626014B2

(12) United States Patent
Heyder et al.

(10) Patent No.: US 6,626,014 B2
(45) Date of Patent: Sep. 30, 2003

(54) DRIVE APPARATUS FOR A FRONT-LOADING LAUNDRY TREATMENT MACHINE

(75) Inventors: Reinhard Heyder, Berlin (DE); Jörg Skrippek, Priort (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 252 days.

(21) Appl. No.: 09/888,033

(22) Filed: Jun. 22, 2001

(65) Prior Publication Data

US 2002/0000108 A1 Jan. 3, 2002

Related U.S. Application Data

(63) Continuation of application No. PCT/EP99/09872, filed on Dec. 13, 1999.

(30) Foreign Application Priority Data

Dec. 22, 1998 (DE) ..... 198 59 567

(51) Int. Cl.[7] ..... D06F 37/30
(52) U.S. Cl. ..... 68/140; 34/601
(58) Field of Search ..... 68/12.16, 24, 140, 68/58; 34/601

(56) References Cited

U.S. PATENT DOCUMENTS 2,861,355 A * 11/1958 Douglas
2,975,528 A * 3/1961 Shewmon
3,167,809 A * 2/1965 Brucken
5,809,809 A * 9/1998 Neumann
5,862,686 A * 1/1999 Skrippek
5,894,746 A * 4/1999 Skripek
5,996,379 A * 12/1999 Skrippek
6,050,113 A * 4/2000 Skrippek et al.
6,131,422 A * 10/2000 Skrippek et al.
6,148,647 A * 11/2000 Kabeya et al.

FOREIGN PATENT DOCUMENTS

DE 3819651 * 12/1989
DE 4414768 * 11/1995
JP 2-68099 * 3/1990

* cited by examiner

*Primary Examiner*—Frankie L. Stinson
(74) *Attorney, Agent, or Firm*—Laurence A. Greenberg; Werner H. Stemer; Ralph E. Locher

(57) ABSTRACT

A compact drive apparatus for a front-loading laundry treatment machine includes a support having a projection and a rear face, a shaft having an axis, a laundry drum having a rear wall, and a motor having magnetic poles and a stator with field windings and laminated cores. The laundry drum is mounted substantially horizontally on the support through the shaft. The rear wall has a bell-shaped depression with an inner circumference. The depression extends in a direction of the longitudinal axis and accommodates the projection. The motor is disposed on the rear face and directly drives the shaft. The laminated cores are disposed on the projection, and the magnetic poles are distributed on the inner circumference and are disposed externally opposite the laminated cores to accommodate the field windings with an air gap therebetween. Preferably, the projection is a bell-shaped flange of the support or of the rear wall of the support to surround the shaft as a bearing sleeve.

17 Claims, 1 Drawing Sheet

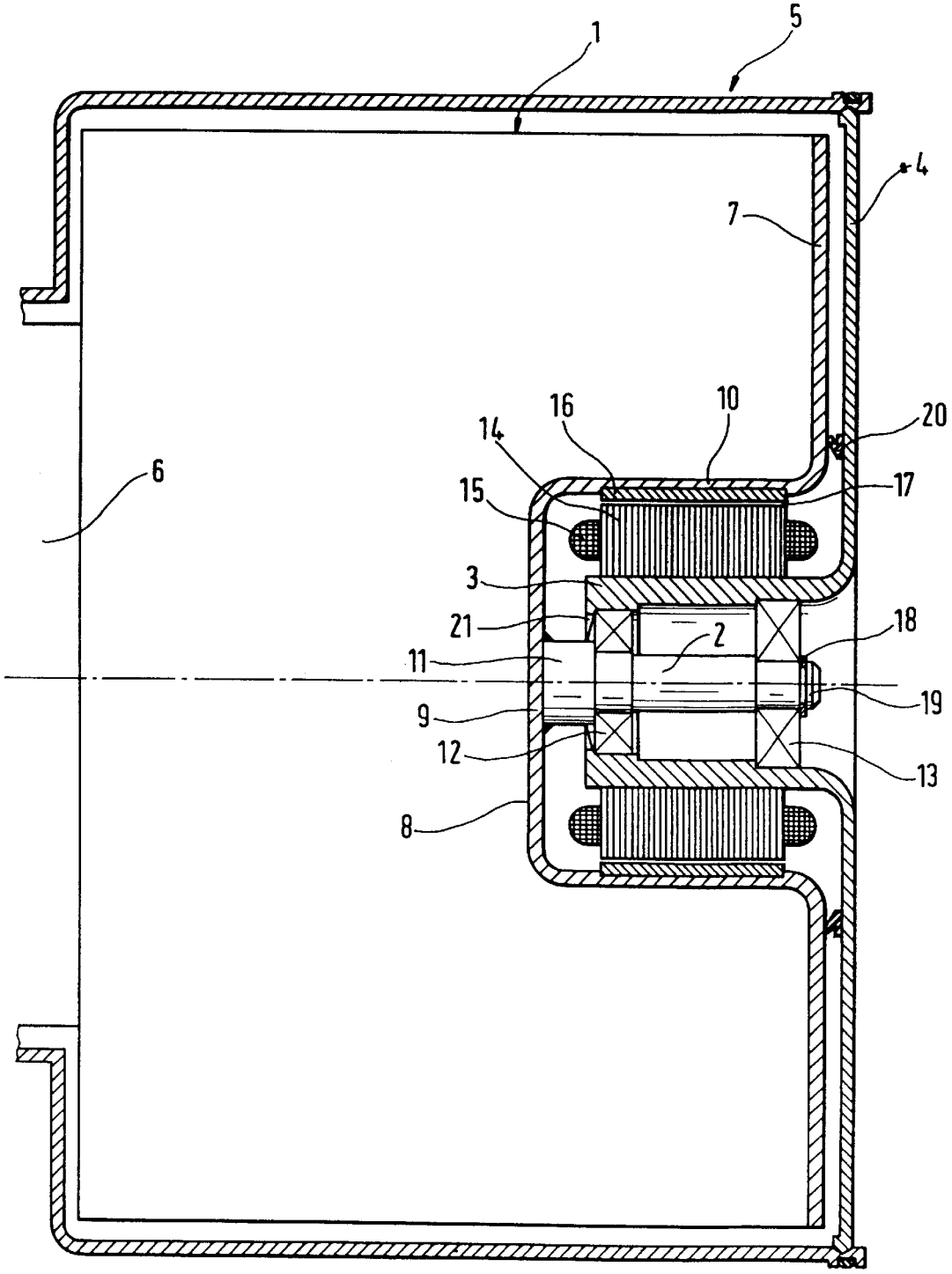
1
5
4
7
16
10
20
14
6
15
17
3
21
18
2
11
19
9
12
13
8

DRIVE APPARATUS FOR A FRONT-LOADING LAUNDRY TREATMENT MACHINE

CROSS-REFERENCE TO RELATED APPLICATION

This application is a continuation of copending International Application No. PCT/EP99/09872, filed Dec. 13, 1999, which designated the United States.

BACKGROUND OF THE INVENTION

Field of the Invention

The invention lies in the field of appliances. The invention relates to a drive apparatus for a front-loading laundry treatment machine having a laundry drum that is mounted at least approximately horizontally and in a supporting part through a shaft and that is driven directly by a motor that is disposed on its rear face and whose magnetic poles that are disposed on the rotor, are externally opposite the laminated cores that are provided on the stator to accommodate field windings, with a minimal air gap.

A drive apparatus is disclosed in German Published, Non-Prosecuted Patent Application DE 195 47 745 A1, corresponding to U.S. Pat. No. 5,862,686 to Skrippek. In the prior art drive apparatus, the stator is mounted on a stiff supporting part that, for its part, is connected to the rear wall of a suds container. The supporting part has a central bearing sleeve for the shaft of the laundry drum and for a hub, which surrounds the shaft, of the rotor. The hub is fitted with a bell-like flange that points toward the suds container and on whose inner circumference magnetic poles are distributed. The magnetic poles are externally opposite laminated cores, which are distributed on the stator and are provided for accommodating field windings of the stator, with a minimal air gap.

SUMMARY OF THE INVENTION

It is accordingly an object of the invention to provide a drive apparatus for a front-loading laundry treatment machine that overcomes the hereinafore-mentioned disadvantages of the heretofore-known devices of this general type and that has a simple, compact construction.

With the foregoing and other objects in view, there is provided, in accordance with the invention, a drive apparatus for a front-loading laundry treatment machine, including a support having a projection and a rear face, a shaft having a longitudinal axis, a laundry drum having a rear wall, the laundry drum mounted substantially horizontally on the support through the shaft, the rear wall having a bell-shaped depression with an inner circumference, the bell-shaped depression extending in a direction of the longitudinal axis and accommodating the projection, a motor having magnetic poles and a stator with field windings and laminated cores, the motor disposed on the rear face and directly driving the shaft, the laminated cores disposed on the projection, and the magnetic poles distributed on the inner circumference and disposed externally opposite the laminated cores to accommodate the field windings with an air gap therebetween.

According to the invention, the rear wall of the laundry drum has a bell-shaped depression that extends in the direction of the longitudinal axis of the shaft and on whose inner circumference, facing the shaft, the magnetic poles of the rotor are distributed, and, in that, the laminated cores of the stator are mounted on the supporting part that projects out of the depression.

The invention provides a drive apparatus that saves material and space. Because the laundry drum has an inward bulge, the drive motor is accommodated in the interior of the laundry drum. Accordingly, there is no need to provide any space for a flat motor, driving the laundry drum directly, or for a drive belt between the rear face of the laundry drum and the rear wall of the laundry treatment machine, that is to say, of the laundry dryer or of the washing machine.

In contrast to the prior art, there is no need to provide any additional components for accommodating the magnetic poles of the rotor and, in fact, the rear wall of the laundry drum is configured such that it accommodates the poles directly. Thus, there is no need for the complex construction of a flange that is, for example, bell-shaped, as is provided according to U.S. Pat. No. 5,862,686.

In accordance with another feature of the invention, there is provided a suds container and the support is part of the suds container.

In accordance with a further feature of the invention, part of the support is at the same time the bearing sleeve for the shaft of the laundry drum and is used as a stator support for accommodating the stator cores. Heat that is produced during operation of the motor is dissipated through the metallic and, thus, thermally highly conductive, rear wall of the laundry drum, and is used to heat the laundry or the washing suds or water.

Because the laundry drum is mounted close to the center of gravity, the configuration reduces the influence of any unbalance or of tumbling.

In accordance with an added feature of the invention, the suds container includes the rear face and the projection, the projection is a bell-shaped flange, and the laminated cores are disposed on the bell-shaped flange.

In accordance with an additional feature of the invention, the bell-shaped flange forms a bearing sleeve of the shaft.

In accordance with yet another feature of the invention, the supporting part is a metal casing, for example, an aluminum casting or a cast-iron casting.

In accordance with yet a further feature of the invention, the bell-shaped flange is a metal casting, for example, an aluminum casting or a cast-iron casting.

The motor is, for example, a reluctance motor, with the magnetic poles of the rotor being laminated iron sheets, or is an electronically commutated DC motor, with the poles being permanent magnets.

In accordance with yet an added feature of the invention, there is provided a seal disposed between the rear wall of the laundry drum and the rear wall of the suds container sealing the motor from laundry suds.

In accordance with yet an additional feature of the invention, the motor is a switched reluctance motor.

In accordance with again another feature of the invention, the magnetic poles are laminated iron sheets.

In accordance with again a further feature of the invention, there are provided laminated iron sheets forming the magnetic poles.

In accordance with again an added feature of the invention, the motor is an electronically commutated DC motor.

In accordance with again an additional feature of the invention, the magnetic poles are permanent magnets.

In accordance with still another feature of the invention, there are provided permanent magnets forming the magnetic poles.

In accordance with still a further feature of the invention, the laminated cores are at least one of segments and rings.

In accordance with still an added feature of the invention, the magnetic poles are at least one of segments and rings.

In accordance with still an additional feature of the invention, the laminated cores and the magnetic poles are opposite one another in a radial direction perpendicular to the longitudinal axis of the shaft.

In accordance with a concomitant feature of the invention, the laminated cores and the magnetic poles are opposite one another in a direction parallel to the longitudinal axis of the shaft.

Other features that are considered as characteristic for the invention are set forth in the appended claims.

Although the invention is illustrated and described herein as embodied in a drive apparatus for a front-loading laundry treatment machine, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

The FIGURE is a cross-sectional view of a laundry drum according to the invention.

DESCRIPTION OF THE PREFERRED EMBODIMENTS

Referring now to the single figure of the drawing, it is seen that a laundry drum 1 is mounted through an essentially horizontally located shaft 2, that is firmly connected to it, such that it can rotate in a bell-shaped flange 3 (that is used as a bearing sleeve for the shaft 2) of a rear wall 4 of a suds container 5. The flange 3 and the rear wall 4 form the supporting part for the laundry drum 1. The laundry drum 1 can be filled with laundry at the front through an opening 6. The laundry drum 1 has a rear wall 7 that has a bell-shaped depression 8 symmetrically with respect to the longitudinal axis of the shaft 2. The depression 8 has a casing wall 10 that connects the bottom 9 to the rear wall 7 and is essentially cylindrical or conical in shape. The bottom 9 of the depression 8 is connected to the shaft 2 through a pin 11 that is, for example, welded to it. The shaft 2 is mounted through bearings 12, 13 (that are ball bearings, for example), in the flange 3, that forms a bearing sleeve for the shaft 2.

The flange 3 at the same time forms the stator to accommodate laminated cores 14 of the motor. The laminated cores 14 are fitted with stator windings 15. Magnetic poles 16 of the rotor are distributed on the inner circumference of the casing wall 10 of the depression 8. The magnetic poles 16 are opposite the laminated cores 14, with a minimal air gap 17. At the end facing away from the laundry drum 1, the shaft 2 ends in a stub shaft 19 that is secured with respect to the bearing 13 through a spring ring 18.

In the illustrated embodiment, the rear wall 4 is fitted with the flange 3, that is used as the supporting part for the shaft 2 and, thus, for the laundry drum 1. To prevent washing suds from penetrating into the region of the motor, that is to say, into the region of the laminated cores 14 and of the poles 16, an annular seal 20 having, for example, an essentially V-shaped cross section is disposed between the rear wall 7 and the rear wall 4.

In the case of a laundry dryer or a hermetically externally sealed laundry drum 1 of a washing machine, there is no outer suds container 5. The flange 3 is connected to a supporting part that, for its part, is connected to the housing, for example through a vibration damper. The supporting part may also extend in the direction of the rear wall 4.

The flange 3 is preferably a metal casting that is composed, for example, of cast aluminum or is a cast-iron casting. The laminated cores 14 are either rings around the flange 3, or are circular segments. The poles 16 may likewise also be rings covering the casing wall 10 from the inside, or segments. Instead of a radial configuration of the laminated cores 14 and of the poles 16, as illustrated, the poles 16 may also be disposed axially with respect to the laminated cores 14. In that configuration, the poles 16 are mounted on the bottom 9 of the depression 8. The laminated cores 14 are opposite them, on the flange 3, including the field windings, and are rotated through 90° with respect to the illustrated embodiment. In such a case, the depression 8 is not as deep as the illustrated embodiment, but has a larger diameter in the radial direction.

In addition to functioning for heat dissipation for the motor, the depression 8 also contributes to absorption of sound from motor noise.

The bearing 12 is encapsulated by a sealing ring 21 on its side opposite the bottom 9.

The laundry drum 1 is driven either by a DC motor with a commutator or by a switched reluctance motor. In the case of an electronically commutated DC motor, the magnetic poles are permanent magnets. In the case of a switched reluctance motor, they are formed by laminated iron sheets.

It is self-evident, in order to improve the cooling effect of the motor, that apertures can be incorporated in the region between the seal 20 and the flange 3 in the rear wall 4 to ensure that the cooling air swirls.

The invention provides a compact drive apparatus, with an essentially horizontally mounted laundry drum 1 having a rear wall 7 with a bell-shaped depression 8. The laundry drum 1 is connected to the shaft 2 that supports it, in the region of the depression 8. A bell-shaped flange 3 on the supporting part or on a rear wall 4 of a suds container 5 that surrounds the shaft 2 as a bearing bush is fitted with laminated cores 14 with stator windings 15 of a stator for a motor, whose magnetic rotor poles 16 are accommodated by the inner circumference of the casing wall 10 of the depression 8.

We claim:

1. A drive apparatus for a front-loading laundry treatment machine, comprising:

a support having a projection and a rear face;

a shaft having a longitudinal axis;

a laundry drum having a rear wall, said laundry drum mounted substantially horizontally on said support through said shaft, said rear wall having a bell-shaped depression with an inner circumference, said bell-shaped depression extending in a direction of said longitudinal axis and accommodating said projection;

a motor having magnetic poles and a stator with field windings and laminated cores, said motor disposed on said rear face and directly driving said shaft;

said laminated cores disposed on said projection; and said magnetic poles distributed on said inner circumference and disposed externally opposite said laminated cores to accommodate said field windings with an air gap therebetween.

2. The drive apparatus according to claim 1, including a suds container, said support being part of said suds container.

3. The drive apparatus according to claim 2, wherein said suds container includes said rear face and said projection, said projection is a bell-shaped flange, and said laminated cores are disposed on said bell-shaped flange.

4. The drive apparatus according to claim 3, wherein said bell-shaped flange forms a bearing sleeve of said shaft.

5. The drive apparatus according to claim 3, wherein the bell-shaped flange is a metal casting.

6. The drive apparatus according to claim 5, wherein said a metal casting is one of the group consisting of an aluminum casting and a cast-iron casting.

7. The drive apparatus according to claim 2, including a seal disposed between said rear wall of said laundry drum and said rear wall of said suds container sealing said motor from laundry suds.

8. The drive apparatus according to claim 1, wherein said motor is a switched reluctance motor.

9. The drive apparatus according to claim 8, wherein said magnetic poles are laminated iron sheets.

10. The drive apparatus according to claim 8, including laminated iron sheets forming said magnetic poles.

11. The drive apparatus according to claim 1, wherein said motor is an electronically commutated DC motor.

12. The drive apparatus according to claim 11, wherein said magnetic poles are permanent magnets.

13. The drive apparatus according to claim 11, including permanent magnets forming said magnetic poles.

14. The drive apparatus according to claim 1, wherein said laminated cores are at least one of segments and rings.

15. The drive apparatus according to claim 1, wherein said magnetic poles are at least one of segments and rings.

16. The drive apparatus according to claim 1, wherein said laminated cores and said magnetic poles are opposite one another in a radial direction perpendicular to said longitudinal axis of said shaft.

17. The drive apparatus according to claim 1, wherein said laminated cores and said magnetic poles are opposite one another in a direction parallel to said longitudinal axis of said shaft.

* * * * *